US006752222B2

(12) United States Patent
Karasawa et al.

(10) Patent No.: US 6,752,222 B2
(45) Date of Patent: Jun. 22, 2004

(54) DOWNHOLE PERCUSSION DRILLS

(75) Inventors: Hirokazu Karasawa, Tsukuba (JP); Tetsuji Ohno, Tsukuba (JP); Akinori Ota, Chiyoda-ku (JP); Tsutomu Kaneko, Yoshii-machi (JP); Naoto Yamada, Isumi-gun (JP); Tetsuomi Miyamoto, Isumi-gun (JP)

(73) Assignees: National Institute of Advanced Industrial Science and Technology, Tokyo (JP); Furukawa Co., Ltd., Tokyo (JP); K. Maikai Co., Ltd., Tokyo (JP)

( * ) Notice: Subject to any disclaimer, the term of this patent is extended or adjusted under 35 U.S.C. 154(b) by 0 days.

(21) Appl. No.: 10/314,944

(22) Filed: Dec. 10, 2002

(65) Prior Publication Data

US 2003/0111240 A1 Jun. 19, 2003

(30) Foreign Application Priority Data

Dec. 14, 2001 (JP) ..... 2001-382274

(51) Int. Cl.[7] ..... B25D 17/22

(52) U.S. Cl. ..... 173/78; 173/79; 173/80; 173/91

(58) Field of Search ..... 173/73, 75, 78, 173/80, 112, 200, 79, 133, 91, 206; 175/296, 92

(56) References Cited

U.S. PATENT DOCUMENTS

| | | | | | |
|---|---|---|---|---|---|
| 3,568,783 | A | * | 3/1971 | Chenoweth et al. | 175/92 |
| 3,620,312 | A | * | 11/1971 | Krasnoff | 173/138 |
| 4,103,591 | A | | 8/1978 | Reiersdal | |
| 4,383,581 | A | * | 5/1983 | Shalashov et al. | 173/16 |
| 4,446,929 | A | * | 5/1984 | Pillow | 173/17 |
| 5,350,023 | A | * | 9/1994 | Klemm | 173/17 |
| 5,396,965 | A | * | 3/1995 | Hall et al. | 173/73 |
| 5,488,998 | A | * | 2/1996 | Ekwall et al. | 173/91 |
| 5,662,180 | A | * | 9/1997 | Coffman et al. | 175/57 |

FOREIGN PATENT DOCUMENTS

| | | |
|---|---|---|
| EP | 0022865 | 6/1980 |
| EP | 0456305 | 11/1991 |
| JP | 55-21352 | 2/1980 |
| WO | 80/01300 | 6/1980 |

* cited by examiner

*Primary Examiner*—Scott A. Smith
*Assistant Examiner*—Nathaniel Chukwurah
(74) *Attorney, Agent, or Firm*—Crowell & Moring LLP

(57) ABSTRACT

Provided is a downhole percussion drill, which is installed at an end portion of a drillstring and performs drilling by giving impact blows to a drill bit at the bottomhole, which includes a hydraulic hammering mechanism 7 which uses oil having high lubricating ability as a driving medium, a hydraulic pump 8 which pressurizes the oil, and a downhole motor 9 which drives the hydraulic pump 8.

2 Claims, 5 Drawing Sheets

DOWNHOLE PERCUSSION DRILLS

BACKGROUND OF THE INVENTION

1. Field of the Invention

The present invention relates to downhole percussion drills in oil, gas, geothermal, and hot spring drilling, etc.

2. Description of the Related Art

The conventional rotary drilling has been widely used for the drilling of oil, gas, geothermal, and hot spring wells, etc. In this method, rock formations are crushed or cut by both of the rotation of a drill bit and the thrust on it.

It has been well known that rates of penetration and wellbore deviation problems can be greatly improved by giving impact blows to the drill bit. However, downhole percussion drills, which generate impact blows, have seldom been applied to deep well drilling, since they have problems as described below.

Air percussion drills for downhole use have been put to practical use in the fields for long time. They use compressed air to reciprocate the hammer to strike the bit and to remove cuttings from the bottomhole to the surface. However, they are not suitable when large influxes of water are encountered, since water invades into the tool and it causes insufficient bottomhole cleaning. Thus, the application of them to the fields has been limited to dry formations.

In order to solve these issues, downhole percussion drills operated by drilling fluids such as mud and water (called mud-driven downhole hammers, simply mud hammers) have been developed and tested worldwide (refer to the Japanese Utility Model Laid-Open No. 55-21352).

Mud hammers, in which the drilling fluid (mud or water) reciprocates the hammer to strike the bit, do not have the limitations of air percussion drills. However, they have several problems; for example, the sticking and cavitation of sliding parts, rapid wear of parts, and the clogging of fluid passages, since the drilling fluid itself has low lubricating ability and it contains abrasive fine rock particles. Although it is well recognized that percussion drilling has several advantages over conventional rotary drilling, we cannot find practical percussion drills that could be applied to the fields under various conditions at present.

SUMMARY OF THE INVENTION

The object of this invention is to offer downhole percussion drills with high reliability and durability, which could be used at various field conditions.

To solve issues mentioned above, a new type of downhole percussion drill was invented, which consists of a hammering mechanism driven by a hydraulic fluid (oil) with high lubricating ability, a hydraulic pump that pressurizes the hydraulic fluid, and a drive unit to operate the hydraulic pump. As the pure hydraulic fluid with high lubricating ability drives the hammering mechanism of this tool instead of drilling mud or water, the sticking and cavitation of sliding parts, rapid wear of parts, and the clogging of fluid passages are minimized. Therefore, this downhole percussion drill provides greatly improved reliability and durability.

Because drilling fluids such as mud and water can be used for the removal of cuttings in the same manner of the mud hammers, the tools also do not have limitations of air percussion drills. If the drilling fluids, used to remove cuttings, were also utilized as a power source of the drive unit, no extra means for supplying power to the drive unit would be needed.

DETAILED DESCRIPTION OF THE PREFERRED EMBODIMENTS

Figure 1:
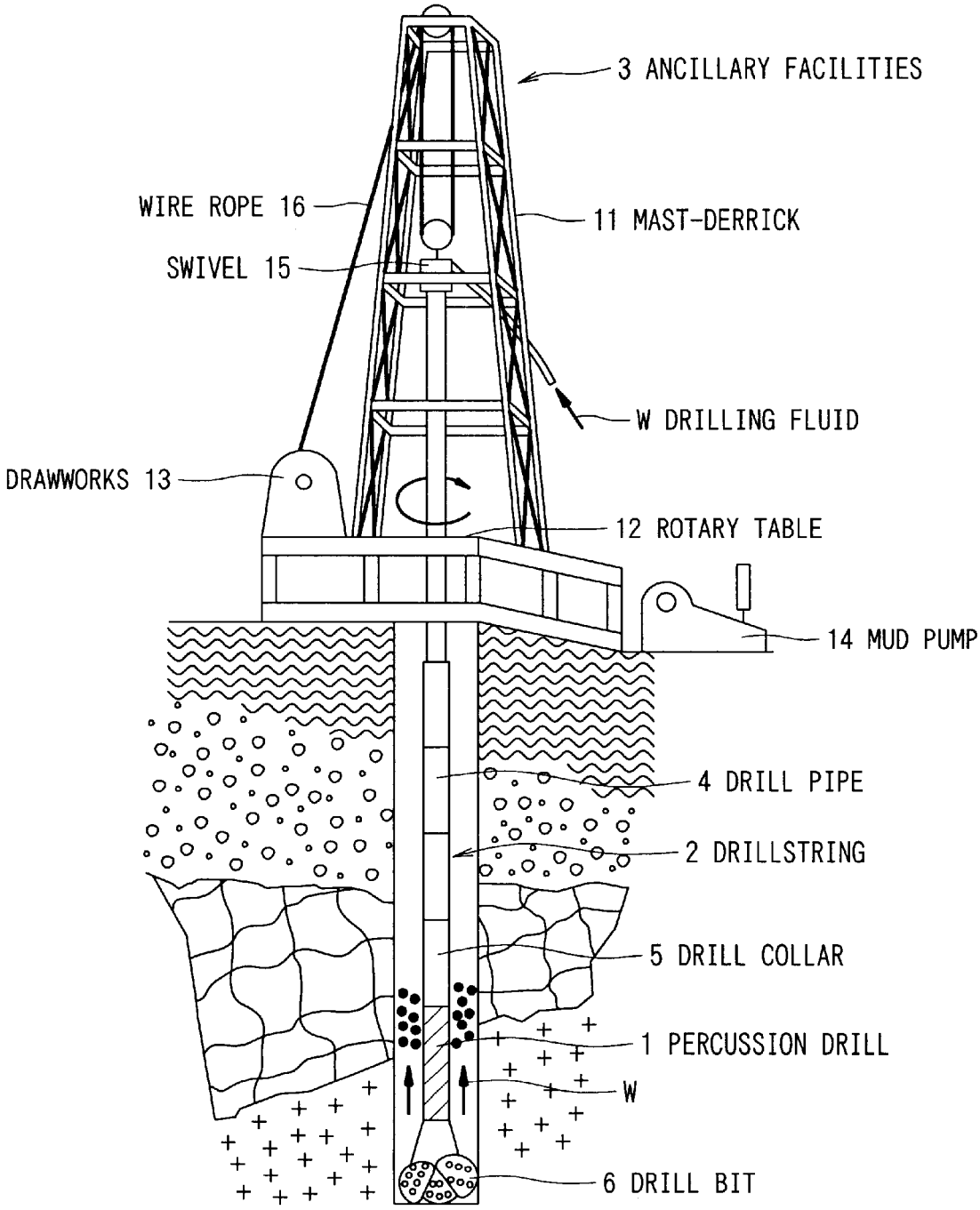
FIG. 1 illustrates a well drilling system (called a drill rig) using the downhole percussion drill invented.
Figure 2:
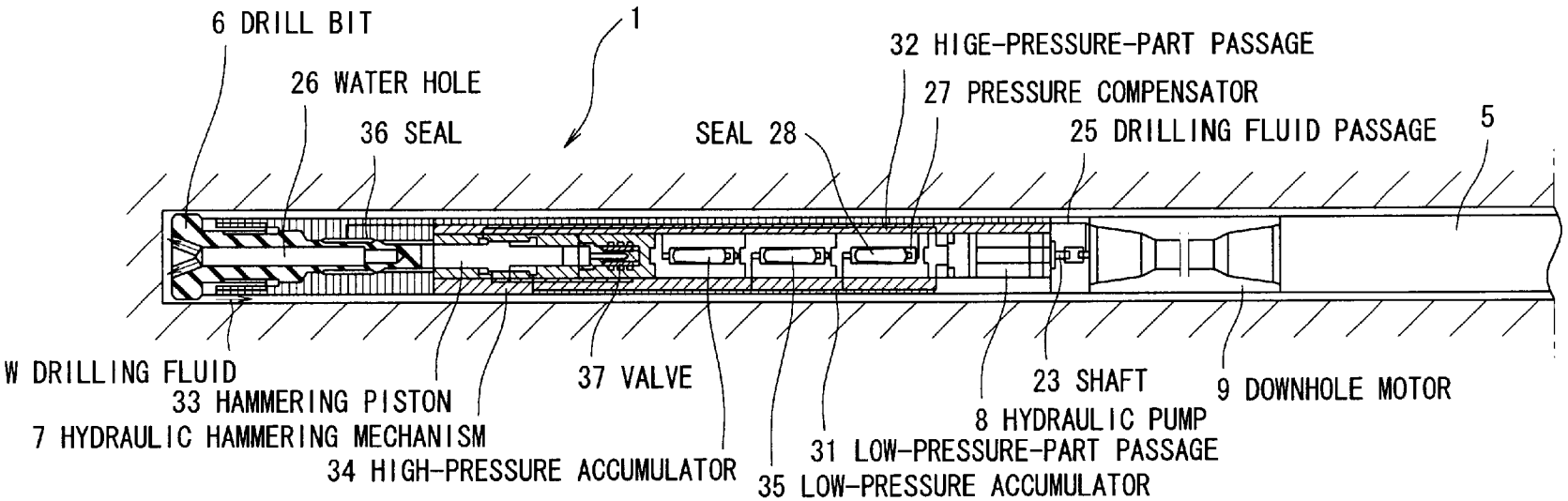
FIG. 2 is a diagram showing the concept of the downhole percussion drills to illustrate an embodiment of the invention.

The drill rig shown in FIG. 1 consists of conventional equipments, except for the percussion drill 1.

This drill rig is comprised of the drillstring 2 and the ancillary facilities 3 which are installed on the surface.

The drillstring 2 consists of the drill pipes 4, drill collars 5, percussion drill 1, and drill bit 6.

The percussion drill 1 includes the hydraulic hammering mechanism 7 operated by pure oil with high lubricating ability, the hydraulic (oil) pump 8 that pressurizes the oil, and the downhole motor 9 that is used to operate the hydraulic pump 8.

The main ancillary facilities 3 installed on the surface are comprised of the mast-derrick 11 used for tripping the drillstring 2, the rotary table 12 that rotates the drillstring 2, the drawworks 13 that provides a power source for the drill rig, the mud pump 14 for supplying the drilling fluid W to the bottomhole, the shale shaker for removing cuttings from the drilling fluid W, and the pit for the drilling fluid W storage (the shaker and pit are omitted in the drawing).

Adding percussion, rotary and weight to the drill bit 6 excavates rock formations in the well.

A part of the weight of the drill collars 5 is loaded on the bit 6. This weight is maintained within an appropriate range for drilling, controlling the tension of the wire rope 16 using the drawworks 13.

The rotation is transmitted to the drill bit 6 through the rotary table 12, drill pipes 4, drill collars 5, and percussion drill 1. In addition, the percussion drill 1 gives impact blows to the drill bit 6.

During drilling, the drilling fluid W stored in the pit is pressurized by the mud pump 14 and supplied to the percussion drill 1 through the swivel 15, drill pipes 4 and drill collars 5, and thereby operates the downhole motor 9.

Figure 3:
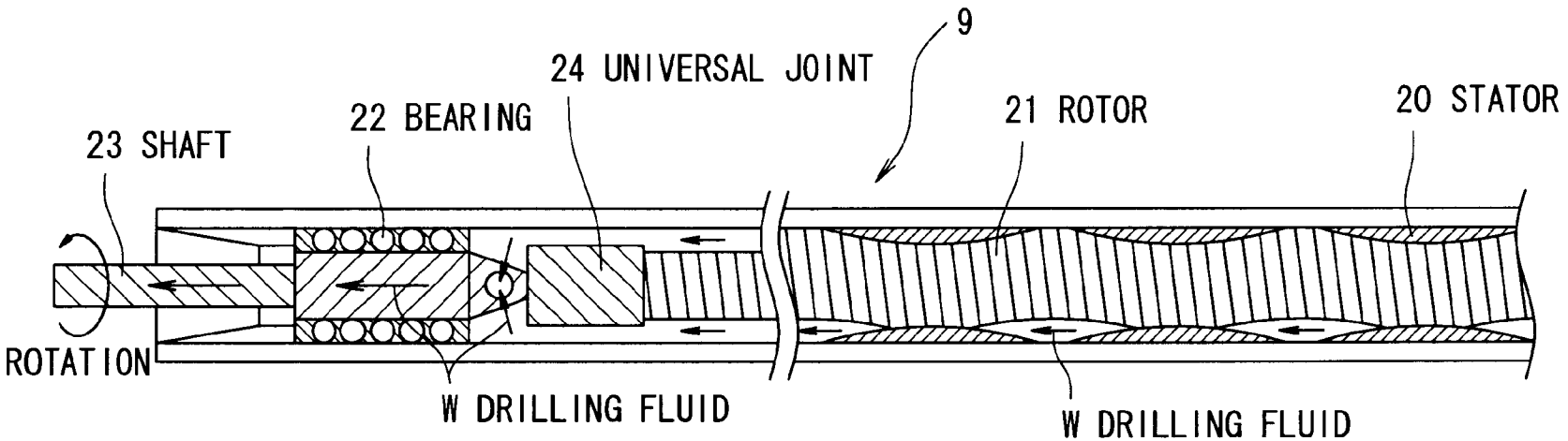
FIG. 3 is an illustration showing the composition of a downhole motor.
Figure 4:
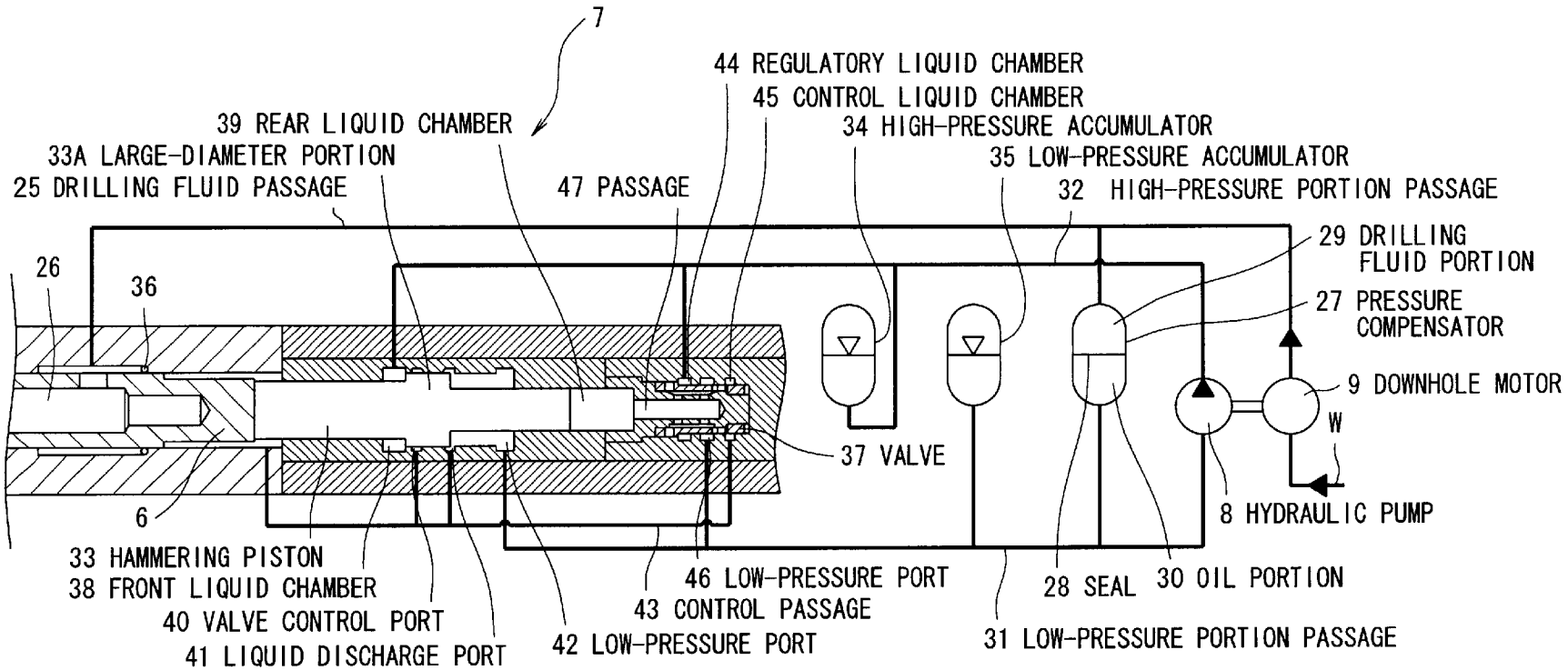
FIG. 4 shows the construction of a hydraulic hammering mechanism.

The type of the downhole motor 9 shown in FIG. 3 is a positive displacement motor. The rotor 21 built within the stator 20 is connected to the shaft 23 supported by the bearing 22 via the universal joint 24.

In the present invention, however, the type of a downhole motor is not limited to the foregoing.

When the drilling fluid W passes through the downhole motor 9, the rotor 21 rotates in the stator 20. Its rotation, which is transmitted to the hydraulic pump 8 via the shaft 23, operates the hydraulic pump 8. The drilling fluid W discharged from the front of the downhole motor 9 passes through the drilling fluid passage 25. It flows into the water hole 26 of the drill bit 6, and then is exhausted to the bottomhole through the nozzles in the drill bit 6.

The circulation of the drilling fluid W transports rock cuttings from the bottomhole to the surface through the annulus between a well wall and the drillstring 2.

The cuttings is removed by the shale shaker from the drilling fluid W discharged to the surface, and the drilling fluid W is stored in the pit and circulated again.

The oil is filled into the space of the hydraulic pump 8 and the hydraulic hammering mechanism 7, to avoid mixing gases such as air in them. Furthermore, the flow passages etc. for oil and drilling fluid W are isolated by seals to prevent mixing, or the loss of oil into the drilling fluid W from the hydraulic hammering mechanism 7.

The pressure compensator 27 consists of the drilling fluid portion 29, the oil portion 30, and the seal 28 that isolates two portions. Apart of the drilling fluid W discharged from the downhole motor 9 is guided to the drilling fluid portion 29 in the pressure compensator 27. The oil portion 30 communicates with the low-pressure portion passage 31 of the hydraulic hammering mechanism 7; therefore, the pressure of the drilling fluid W is transmitted to the oil via the seal 28. Thus, the mixing of drilling fluid into the oil in the hydraulic hammering mechanism 7 is minimized, since the oil pressure in the low-pressure portion passage 31 is maintained at the same pressure of the drilling fluid W by the pressure compensator 27, independent of the well depth and small changes of the oil volume.

In addition, changes of the oil volume, which are caused by changes of the oil pressure, can be minimized by filling the space with the oil so that gasses such as air do not mix in. It is desirable that the oil filled in the space is deaerated beforehand.

The hydraulic pump 8, which is driven by the rotation of the rotor 21 in the downhole motor 9, absorbs and pressurizes the oil in the low-pressure portion passage 31 and exhausts the high-pressure oil to the high-pressure portion passage 32.

The hammering piston 33, included in the hydraulic hammering mechanism 7, is reciprocated by high-pressure oil supplied from the high-pressure portion passage 32 and repeatedly strikes the drill bit 6. The oil used for reciprocating motion of the hammering piston 33 returns to the hydraulic pump 8, through the low-pressure portion passage 31.

To reduce oil pressure fluctuations associated with the reciprocating motion of the hammering piston 33, the high-pressure accumulator 34 and the low-pressure accumulator 35 are included in the high-pressure portion passage 32 and the low-pressure portion passage 31, respectively.

An increase of the oil pressure due to increases of the drilling depth decreases the volume of a filled gas in the high-pressure accumulator 34 and the low-pressure accumulator 35; therefore, the volume of spaces of hydraulic pump 8 and the hydraulic hammering mechanism 7, where the oil flows, increases by the same volume reduced. This increment of the space volume is compensated by a change in the volumes of the drilling fluid portion 29 and the oil portion 30 in the pressure compensator 27.

In the drilling fluid passage 25 linked to the drill bit 6, the seal 36 is included to prevent an invasion of the drilling fluid W into the oil in the hydraulic hammering mechanism 7.

This hydraulic hammering mechanism 7 employs the method in which the front liquid chamber 38 is always pressurized and the pressure of the rear liquid chamber 39 is changed, as a method to reciprocate the hammering piston 33. However, in this invention, the operation method of the hammering piston 33 is not limited to this method.

In the hydraulic hammering mechanism 7, sliding parts of the hammering piston 33 and the valve 37 are fitted so that they can move forward and backward. In the hydraulic hammering mechanism 7, the hammering piston 33, valve 37, high-pressure accumulator 34, low-pressure accumulator 35, and pressure compensator 27 are arranged in a line in the order from the bottomhole, so that they can be set within an outside diameter of the drill collar 5. The drill bit 6 is connected beneath the hammering piston 33.

The hammering piston 33 has the large-diameter portion 33A in its middle portion, and the front liquid chamber 38 is made beneath the large-diameter portion 33A. The rear liquid chamber 39 is formed above the hammering piston 33. In the hammering piston 33, the area pressurized on the rear liquid chamber 39 is larger than that on the front liquid chamber 38.

The high-pressure portion passage 32 communicates with the front liquid chamber 38 and therefore, the oil pressurized by the hydraulic pump 8 is constantly supplied to the front liquid chamber 38.

In the front liquid chamber 38, the valve control port 40 and the liquid discharge port 41 are included so that they are opened and shut by the large-diameter portion 33A, during the reciprocating motion of the hammering piston 33. In behind the liquid discharge port 41, the low-pressure port 42 is provided so that it communicates with the liquid discharge port 41 at an advance position of the hammering piston 33.

The valve control port 40 and the liquid discharge port 41 always communicate with the control passage 43, and the low-pressure port 42 always communicates with the low-pressure portion passage 31.

The valve 37 is disposed at behind the hammering piston 33, in order to communicate the rear liquid chamber 39 of the hammering piston 33 with either of the high-pressure portion passage 32 or the low-pressure portion passage 31.

The regulatory liquid chamber 44 and the control liquid chamber 45 are formed in the valve 37. In the valve 37, the area pressurized on the control liquid chamber 45 is larger than that on regulatory liquid chamber 44. The regulatory liquid chamber 44 communicates with the high-pressure portion passage 32, and therefore, the oil pressurized by the hydraulic pump 8 is always supplied to the liquid chamber 44. The control liquid chamber 45 always communicates with the control passage 43.

The low-pressure port 46 is provided between the regulatory liquid chamber 44 and the control liquid chamber 45, and always communicates with the low-pressure portion passage 31.

When the high-pressure oil enters the regulatory liquid chamber 44 from the high-pressure portion passage 32, the valve 37 move forward and the rear liquid chamber 39 communicates with the low-pressure portion passage 31, though the passage 47 and the low-pressure port 46.

On the other hand, when the high-pressure oil enters the control liquid chamber 45 from the control passage 43, the valve 37 moves backward, thereby causing the communication between the rear liquid chamber 39 and the high-pressure portion passage 32, via the passage 47 and the regulatory liquid chamber 44. Because, the area pressurized on the control liquid chamber 45 is larger than that on regulatory liquid chamber 44, as described above.

The operation of the hydraulic hammering mechanism 7 will be described below by referring to FIGS. 5(*a*) to 5(*d*).

Figure 5:
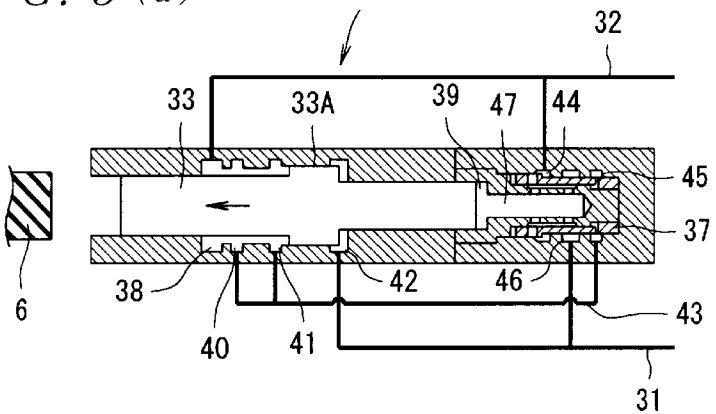
FIG. 5 exhibits how a hammering piston reciprocates to strike the bit.
Figure 5:
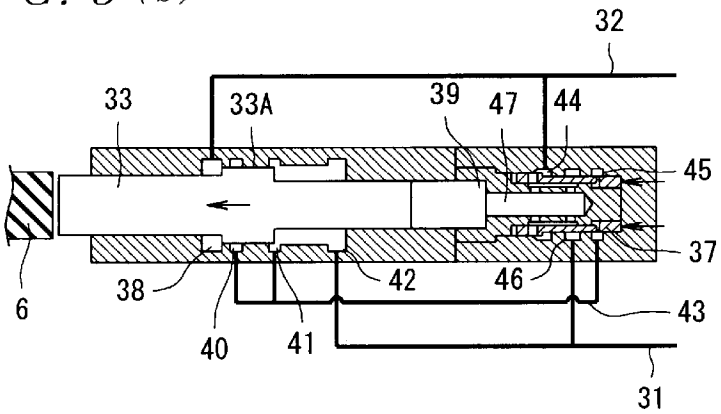
Figure 5:
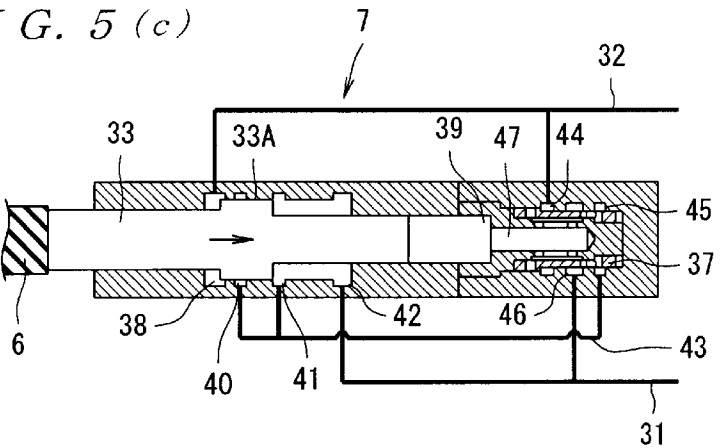
Figure 5:
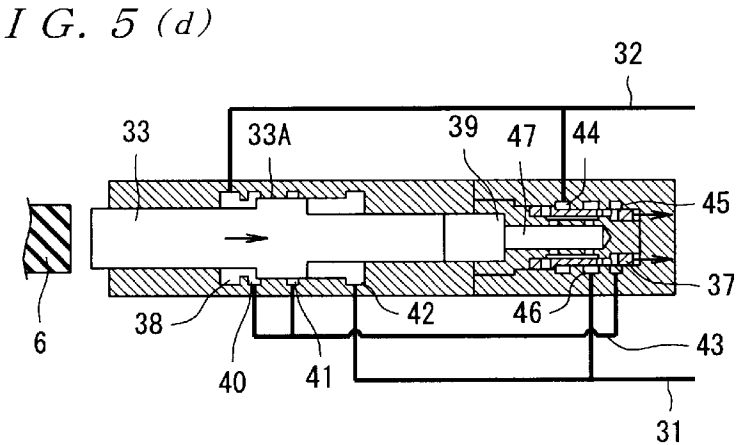

In FIG. 5(*a*), the hammering piston 33 locates in a back position. In this condition, the control passage 43 communicates with the front liquid chamber 38 via the valve control port 40, and the liquid discharge port 41 is shut off from the low-pressure port 42 by the large-diameter portion 33A. Therefore, the high-pressure oil flows into the control liquid chamber 45 from the control passage 43, and the valve 37 is kept in the back position.

The high-pressure oil then enters the rear liquid chamber 39 through the passage 47 and regulatory liquid chamber 44. Because the area pressurized on the rear liquid chamber 39 is larger than that on the front liquid chamber 38; therefore, the hammering piston 33 moves forward.

As shown in FIG. 5(*b*), when the hammering piston 33 has moved forward to a position where just before it impacts the drill bit 6, the communication between the front liquid chamber 38 and the valve control port 40 is closed by the large-diameter portion 33A of the hammering piston 33, providing the communication between the liquid discharge port 41 and the low-pressure port 42. Therefore, the oil pressure in the control passage 43 and the control liquid chamber 45 becomes low.

Because the regulatory liquid chamber 44 always communicates with the high-pressure portion passage 32, the valves 37 moves forward to a position where the rear liquid chamber 33 communicates with the low-pressure portion passage 31, via the passage 47 and the low-pressure port 46.

As can be seen in FIG. 5 (*c*), after the hammering piston 33 gives an impact blow to the drill bit 6, the oil pressure in the rear liquid chamber 39 of the piston 33 becomes low and the oil pressure in the front liquid chamber 38 is constantly high, with the result that the hammering piston 33 starts to move backward.

As shown in FIG. 5(*d*), the large-diameter portion 33A shuts off the communication between the liquid discharge port 41 and the low-pressure port 42, and the control passage 43 communicates with the front chamber 38 through the valve control port 40, during the backward movement of the hammering piston 33. Therefore, the oil pressure in the control liquid chamber 45 becomes high again, and the valve 37 begins to move the back position.

When the valve 37 moves, the communication between the rear liquid chamber 39 of the hammering piston 33 and the low-pressure portion passage 31 is shut off via the low-pressure port 46, and the rear liquid chamber 39 communicates with the high-pressure portion passage 32 through the passage 47 and the regulatory liquid chamber 44. Therefore, the hammering piston 33 that has moved backward decelerates and stops by braking, and then moves forward again.

The same cycles as described above are repeated.

As can be understood from the above descriptions, in the hydraulic hammering mechanism 7, sliding parts of the hammering piston 33 and the valve 37 are required to provide the small clearance between the sliding parts and the tool body, in order to improve the hammering efficiency as high as possible. These sliding parts are subjected to severe lubricating conditions due to their high-speed reciprocating motion with the small clearance.

For this reason, in the prior art we could not often avoid the stop of the hammering mechanism, due to the sticking of the sliding parts caused by abrasive fine rock particles included in the drilling fluids.

Moreover, in the prior art the impact surfaces both of the hammering piston and the drill bit were covered by the drilling fluid that has low lubricating ability and contains abrasive fine rock particles; therefore, it was impossible to avoid the cavitation and erosion caused by shocks during hammering, and the wear caused by hammering surrounded by abrasive fine rock particles.

In the downhole percussion drills invented, all these parts are immersed in the pure hydraulic fluid with high lubricating ability. Thus, these issues mentioned above can be avoided.

As described above, the downhole percussion drills invented have high durability and reliability of the hammering mechanism even in an environment in which ground water is encountered, and can be used in various field conditions.

What is claimed is:

1. A downhole percussion drill, which is installed at an end portion of a drillstring and performs drilling by giving impact blows to a drill bit at the bottomhole, comprising:

a hydraulic hammering mechanism, said hydraulic hammering mechanism using a fluid having a high lubricating ability as a driving mediums said fluid being isolated from a drilling fluid;

a hydraulic pump adjacent to said hydraulic hammering mechanism, said hydraulic pump pressurizing said driving medium;

a pressure compensator, said compensator maintaining a pressure of the driving medium in a low-pressure portion passage of the hydraulic hammering mechanism at the same pressure as the drilling fluid; and a drive unit, said drive unit driving said hydraulic pump.

2. The downhole percussion drill according to claim 1, wherein a power source of said drive unit is a drilling fluid used to remove rock cuttings.

* * * * *